United States Patent [19]

Carella

[11] 4,175,536

[45] Nov. 27, 1979

[54] COMBINATION OF A BOW AND A POWER HANDLE

[76] Inventor: Richard F. Carella, 35572 Strathcona, Mt. Clemens, Mich. 48043

[21] Appl. No.: 839,022

[22] Filed: Oct. 3, 1977

[51] Int. Cl.[2] ..... F41B 5/00

[52] U.S. Cl. ..... 124/23 R; 124/88

[58] Field of Search ..... 124/23 R, 24 R, 88, 124/41 A, 23, 86

[56] References Cited

U.S. PATENT DOCUMENTS

| | | | |
|---|---|---|---|
| 306,234 | 10/1884 | Fox | 124/24 R |
| 586,713 | 7/1897 | Peters | 124/24 R |
| 1,161,642 | 11/1915 | Enos | 124/23 R |
| 2,116,650 | 5/1938 | Zima | 124/23 R |
| 3,415,241 | 12/1968 | Bear | 124/24 R |
| 3,416,508 | 12/1968 | Thompson | 124/24 R |
| 3,981,290 | 9/1976 | Islas | 124/24 R |
| 4,041,927 | 8/1977 | Van House | 124/24 R X |
| 4,078,537 | 3/1978 | Carella | 124/24 R |

*Primary Examiner*—Richard C. Pinkham
*Assistant Examiner*—William R. Browne
*Attorney, Agent, or Firm*—McGlynn and Milton

[57] ABSTRACT

A combination of a bow and power handle, the power handle will isolate an archer's hand from the bow in order to prevent the archer's hand from effecting the position of the bow which would, in turn, change the direction of the arrow. In addition, the instant invention adds energy to the bow in order to increase force to an arrow which increases the flight distance when the arrow is launched. The assembly includes an archery bow having limbs interconnected by a bowstring which is movable to a drawn position to impart energy to an arrow upon release of the bowstring from the drawn position. A power means is formed from a connecting portion and a biasing portion and includes a suitable handle. The power handle is adapted to be gripped by an archer and is connected to the bow for movement relative thereto between an energy-storing position and a release position for storing energy when gripped by an archer in the drawn position and for imparting the stored energy to the bow upon release of the bowstring from the drawn position. The connecting portion connects the power assembly to the bow. In the first two embodiments the biasing portion is comprised of resilient members while in a third embodiment the biasing portion is comprised of a spring.

13 Claims, 5 Drawing Figures

COMBINATION OF A BOW AND A POWER HANDLE

BACKGROUND OF THE INVENTION

1. Field of the Invention

The subject invention relates to an improved handle for use with an archery bow. In archery, the shock imparted by a bowstring when it is released to launch an arrow will cause a jerking or cocking motion of the archer's hand holding the bow. This jerking or cocking of the archer's hand will effect the position of the bow which will, in turn, change the direction of the arrow. Consequently, it is desirable to have a handle which is independent of the bow and which isolates the archer's hand from the bow in order to reduce the arrow release shock transmitted to an archer's hand. In addition, it is also desirable to impart additional energy to the bow upon release of the bowstring which adds an increased force to the arrow in order to increase the flight distance of the arrow.

2. Description of the Prior Act

Typically, the prior art shock-absorbing or energy-absorbing handles for archery bows generally include a handle which is independent of the bow and which isolates the archer's hand from the bow in order to release the arrow release shock transmitted to an archer's hand. The prior art devices, however, do not include the novel feature of an energy-absorbing handle which is independent of the bow and which also imparts an additional force to an arrow, when launched, to increase flight distance.

SUMMARY OF THE INVENTION

The subject invention relates to an archery bow assembly comprising a bow having limbs interconnected by a bowstring which is movable to a drawn position to impart energy to an arrow upon release of the bowstring from the drawn position. Power means adapted to be gripped by an archer and connected to the bow for movement relative thereto between an energy-storing position and a release position for storing energy when gripped by an archer in the drawn position and for imparting the stored energy to the bow upon release of the bowstring from the drawn position. The power means includes a connecting portion for connection to the bow.

PRIOR ART STATEMENT

A shock-absorbing handle for an archer's bow is shown in U.S. Pat. No. 3,513,820, granted May 26, 1970 to G. D. Thompson. The handle disclosed in this patent allows a bow to slide on a stud which is attached to a hilt having a contoured grip for an archer's hand. The shock of launching an arrow is not transmitted to the archer's hand until the arrow has left the bow. This patent, however, does not disclose a shock-absorbing or energy-absorbing handle which is independent of the bow and which imparts an additional force to an arrow, when launched, to increase flight distance.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF PREFERRED EMBODIMENTS

Figure 1:
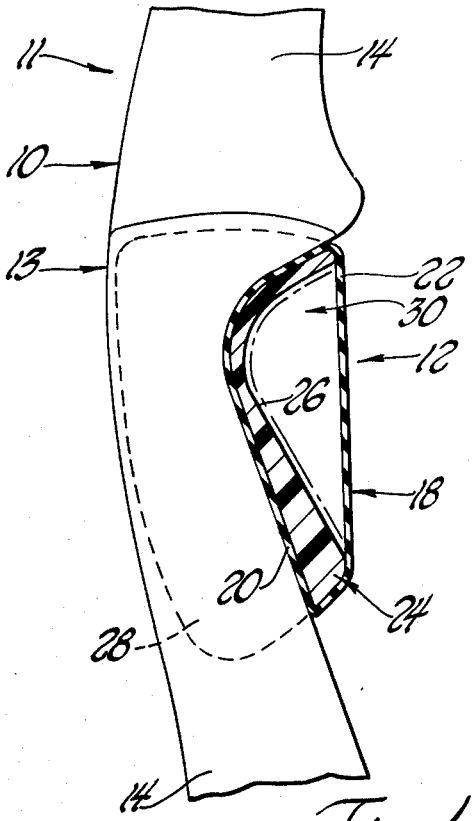
FIG. 1 is a fragmentary side view and partially in cross section of a first embodiment of a power handle for a bow assembly constructed in accordance with the instant invention.

Referring to the drawings generally, an archery bow assembly is generally shown at 11 which includes an archery bow generally indicated at 10 and a handle assembly generally shown at 12.

The archery bow 10 may be one of various configurations well-known in the prior art and includes a bow 10 having limbs 14 which extend from a contoured gripping or handle portion generally indicated at 13 of the bow 10. The limbs 14 are interconnected by a bowstring 16 which is movable to a drawn position to impart energy to an arrow upon release of the bowstring 16 from the drawn position. In other words, the bow 10 acquires a potential energy when the bowstring 16 is drawn which, when the bowstring 16 is released, is imparted to an arrow and causes the arrow to leave the bow to depart in its aimed course.

Power means for movement relative to the bow 10 between an energy-storing position and a release position is generally indicated at 18. The power means 18 is adapted to be gripped by an archer and is connected to the bow 10. The power means 18 stores energy when gripped by an archer when the bow 10 and bowstring 16 are in the drawn position and the power means 18 imparts the stored energy to the bow 10 upon release of the bowstring 16 from the drawn position. Thus, when an archery bow assembly 11 includes power means 18, the quantum of energy imparted to the bow 10 when the bowstring 16 is released is the combination of the potential energy acquired by the bow 10 when the bowstring 16 is drawn and the stored energy from the power means 18.

The power means 18 includes a connecting portion 20 for connection to the bow 10. The power means 18 also includes a biasing portion 22 for biasing the power means 18 to the released position. The power means 18 further includes handle means generally indicated at 24 adapted to be gripped by an archer.

The handle means 24 includes a base portion 26 and a pair of flanges 28 extending from the sides of the base portion 26 and along opposite sides of the contoured portion 13 of the bow 10.

In the embodiment shown in FIG. 1, the flanges 28 are connected to the contoured portion 13 of the bow 10. The base portion 26 includes a cavity generally indicated at 30 for receiving an archer's hand. The biasing portion 22 in the embodiment shown in FIG. 1 comprises a resilient member which is disposed tautly across the cavity 30 when the power means 18 is in the released position. Thus, the power means 18 in this embodiment is formed of a resilient or elastic strap which is typically one piece. The elastic strap surrounds the base portion 26 of the handle 24 which defines an exposed portion or biasing portion 22 and an unexposed or connecting portion 20.

Still referring to the embodiment as shown in FIG. 1, in operation the archer will grasp the handle 24 and the exposed or biasing portion 22 of the power means 18. When an archer draws the bowstring 16 to the drawn position this will cause the exposed portion or biasing portion 22 to be compressed towards the base portion 26 of the handle 24. In other words, when the bowstring 16 is in the drawn position the power means 18 moves relative to the bow 10 and is in the energy-storing position. When an arrow is launched however, the biasing portion 22 returns to its original or release position tautly disposed across the cavity 30 which provides the release position of the power means 18. This operation will tend to push the archer's hand away from the bow 10 so that any jerking or cocking of the archer's hand will not effect the position of the bow 10 which would, in turn, change direction of the arrow. In addition, the release of energy in the elastic strap 20, 22 increases the length of flight of the arrow. In other words, the movement of the power means 18 relative to the bow 10 between the energy-storing position and the release position isolates the archer's hand from the bow 10 and imparts additional energy to the bow 10 upon release of the bowstring to provide an additional force to the arrow.

Figure 2:
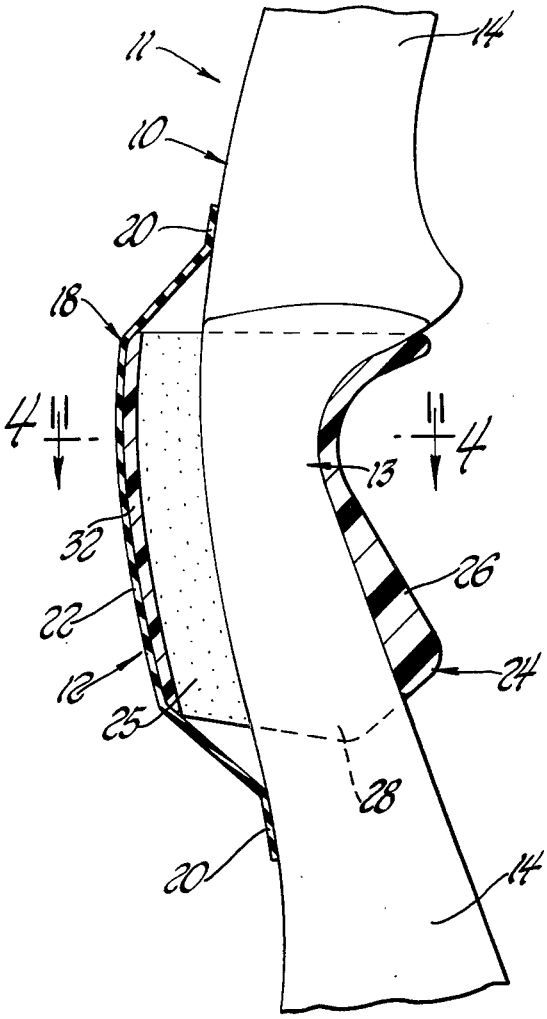
FIG. 2 is a fragmentary side view and partially in cross section illustrating a second embodiment of a power handle for a bow assembly constructed in accordance with the instant invention.
Figure 3:
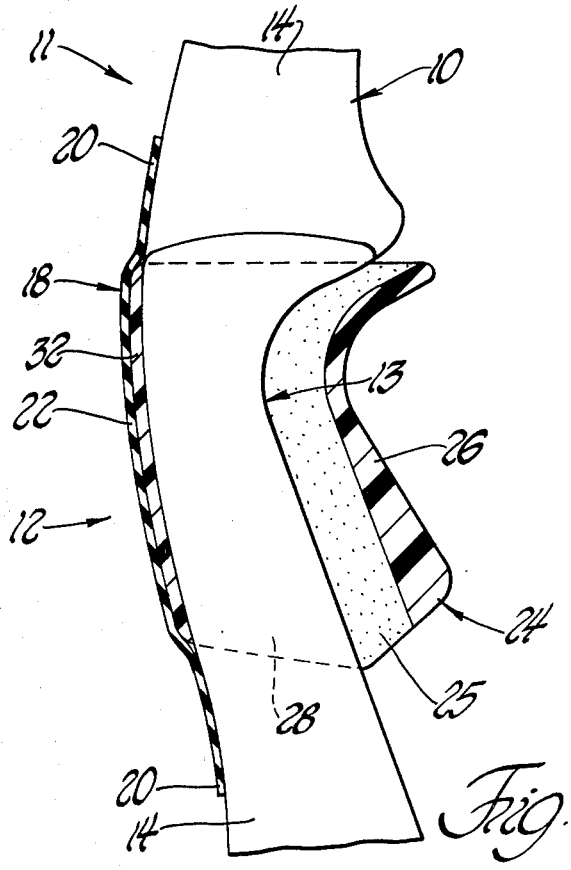
FIG. 3 is a fragmentary side view and partially in cross section of the embodiment shown in FIG. 2 in an alternative position.
Figure 4:
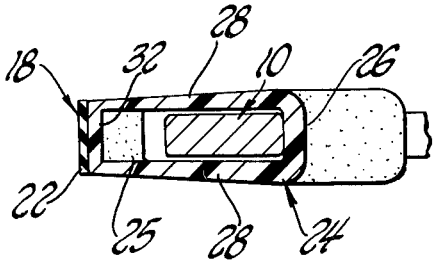
FIG. 4 is a fragmentary cross-sectional view taken substantially along line 4—4 of FIG. 2.

Referring now to FIGS. 2, 3 and 4, another embodiment of the instant invention is shown. In this embodiment, the biasing portion 22 comprises a resilient member which interconnects the handle means 24 and the bow 10. A rear connecting member 32 connects the extending flanges 28. The distance between the flanges 28 is greater than the width of the contoured portion 13 of the bow 10 over which the handle means 24 is disposed thereover in order to allow the handle means 24 to be slidably disposed over the contoured portion 13 of the bow 10. Thus, the handle means 24 is movable relative to the bow 10 through the space 25. The base portion 26 of the handle 24 is engageable with the bow 10 when the power means 18 is in the energy-storing position as shown in FIG. 2. The resilient member or biasing portion 22 includes a connecting portion 20 which is attached to the bow 10 by glue or the like.

The biasing portion biases the power means 18 to the released position and this condition is shown in FIG. 3. Referring to FIGS. 2 and 4, when the bowstring is in the drawn position the base portion 26 will be engageable with the contoured portion 13 of the bow 10 in order to provide the energy-storing position of the power means 18. Referring to FIG. 3, when the bowstring is released from the drawn position in order to launch an arrow, the bow 10 will move away from the base 26 of the handle 24 and the bow will be in its normal position with the bow 10 against the rear member 32 in order to provide the energy-release position of the power means 18. In short, the bow 10 is allowed to float within the handle means 24 in order to allow the movement between the energy-stored and energy-released positions of the power means 18. This again, isolates an archer's hand from the bow 10 when an arrow is launched and adds increased force to the arrow in order to increase the flight distance.

Figure 5:
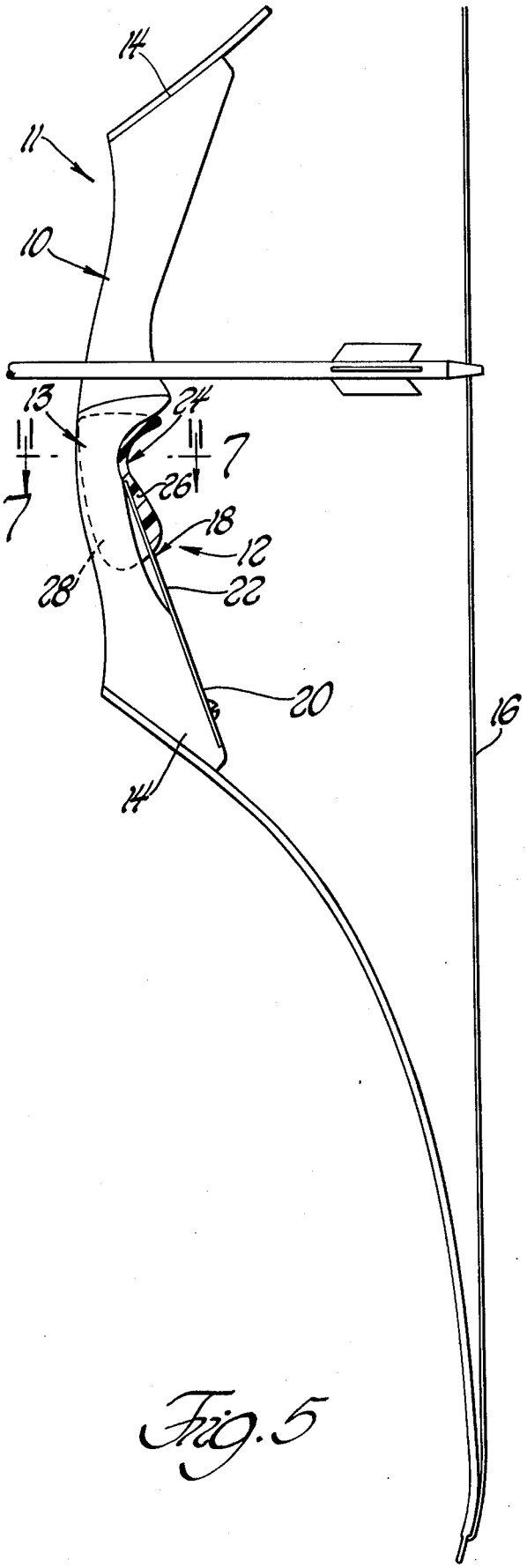
FIG. 5 is a fragmentary side view and partially in cross section illustrating a third embodiment of the instant invention.
Figure 6:
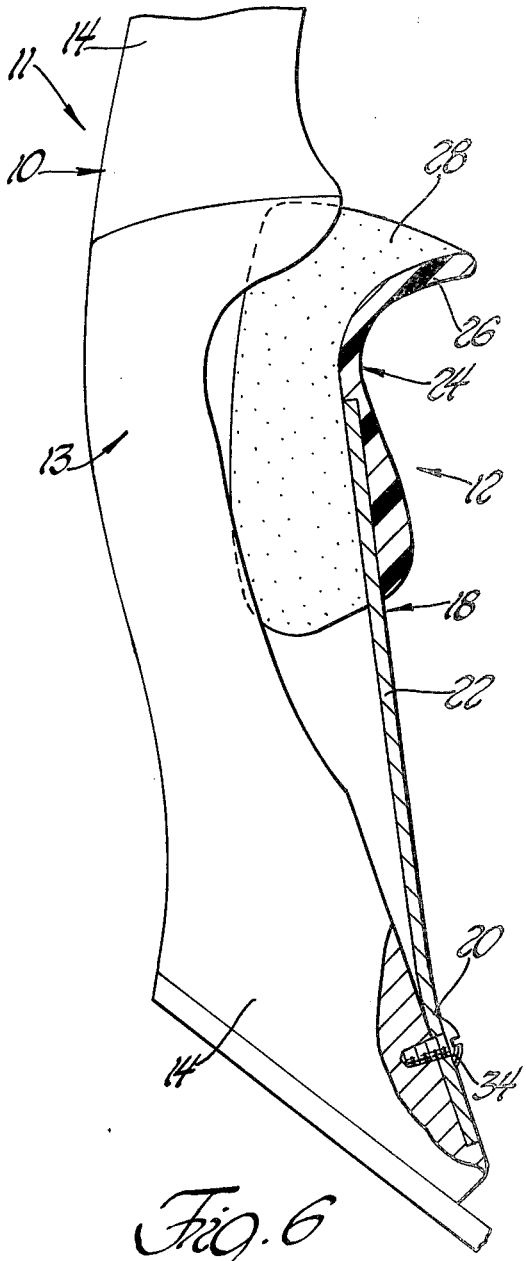
FIG. 6 is a fragmentary side view and partially in cross section similar to the embodiment shown in FIG. 5 in an alternative position.
Figure 7:
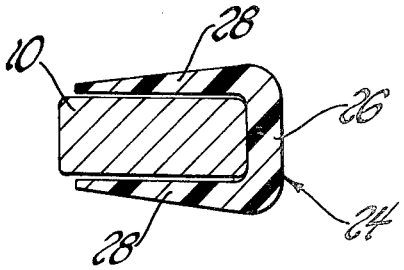
FIG. 7 is a cross-sectional view taken substantially along line 7—7 of FIG. 5.

Still another embodiment of the instant invention is shown in FIGS. 5, 6 and 7. In this form of the invention, the biasing means 22 is comprised of a spring which interconnects the handle means 24 and the bow 10. More specifically, the spring is comprised of a metal leaf spring as shown in FIGS. 5 and 6. Referring to FIGS. 5 and 7, when the power means 18 is gripped by an archer and the bowstring 16 is in the drawn position, the base 26 of the handle means 24 will be compressed toward the engageable with the bow 10. Referring to FIG. 6, the biasing portion 22 which is comprised of a spring, biases the handle means 24 of the power means 18 to the release position. There is a connecting portion 20 for connecting the power means 18 to the bow 10 by way of a screw 34 or the like. In short, the leaf spring isolates an archer's hand from the bow 10 when an arrow is launched and imparts the stored energy of the power means 18 to the bow 10 upon release of the bowstring 16 from the drawn position.

An additional advantage of the instant invention is that a condition known in archery as arrow paradox is reduced. When an arrow is launched, the rear part of the arrow tends to move more than the front part of the arrow since the force imparted to an arrow is from the rear. This causes the arrow to bend which will, in turn, change the direction of the arrow. Since the bow 10 moves forward in the instant invention, the arrow paradox is considerably reduced.

A further advantage of having the bow 10 move forward when launching an arrow is that once the bow 10 is in motion there is a natural tendency to remain in motion. Said another way, the bow as it is moving provides a stable platform. As a result, the bow will not deflect the arrow from its aimed course.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed defined as follows:

1. An archery bow assembly comprising; a bow having limbs, a bowstring interconnecting said limbs and movable to a drawn position to impart energy to an arrow upon release of the bowstring from the drawn position, and power means adapted to be gripped by an archer and connected to said bow for movement in the plane formed by the bow and the bowstring between an energy-storing position and a bowstring release position, said power means storing energy when the power means is acted upon by a force by an archer during the draw and for releasing said stored energy to be bow in said plane to move the entire bow forwardly upon release of the bowstring from the drawn position and relaxation of the force applied to the power means by an archer said power means including a connecting portion for connection to said bow.

2. An assembly as set forth in claim 1 wherein said power means includes a biasing portion for biasing said power means in said plane to said energy release position.

3. An assembly as set forth in claim 2 wherein said power means includes handle means adapted to be gripped by an archer.

4. An assembly as set forth in claim 3 wherein said handle means includes a base portion and a pair of flanges extending from the sides of said base and along opposite sides of said bow.

5. An assembly as set forth in claim 4 wherein said flanges are connected to said bow.

6. An assembly as set forth in claim 5 wherein said base portion includes a cavity for receiving an archer's hand, and said biasing portion comprises a resilient member disposed tautly across said cavity in said released position.

7. An assembly as set forth in claim 4 wherein said handle means is movable relative to said bow, said base portion thereof being engageable with said bow when in said energy-storing position.

8. An assembly as set forth in claim 7 wherein said biasing portion comprises a resilient member interconnecting said handle means and said bow.

9. An assembly as set forth in claim 7 wherein said biasing means comprises a spring interconnecting said handle means and said bow.

10. An assembly as set forth in claim 9 wherein said spring comprises a leaf spring.

11. A handle assembly for use with an archery bow having a bowstring movable to a drawn position to impart energy to an arrow upon release of the bowstring from the drawn position and comprising power means adapted to be gripped by an archer and adapted to be connected to a bow for movement in the plane formed by a bow and a bowstring between an energy-storing position and a bowstring release position, said power means storing energy when the power means is acted upon by a force by an archer during draw and for releasing said stored energy to a bow in said plane to move an entire bow forwardly upon release of a bowstring from the drawn position and relaxation of the force applied to the power means by an archer, said power means including a connecting portion for connection to a bow.

12. An assembly as set forth in claim 11 wherein said power means includes a handle means adapted to be gripped by an archer and a biasing portion for biasing said power means in said plane to said energy release position.

13. An assembly as set forth in claim 12 wherein said handle means is adapted to move relative to the bow between said energy-storing position and said release position and said biasing portion biases said handle means to said release position.

* * * * *